United States Patent [19]

Saukkonen et al.

[11] Patent Number: 4,883,233

[45] Date of Patent: Nov. 28, 1989

[54] METHOD FOR CONTROLLING THE REELING OF A WEB

[75] Inventors: Seppo Saukkonen, Vantaa; Kauko Tomma, Helsinki, both of Finland

[73] Assignee: Valmet Paper Machinery, Inc., Finland

[21] Appl. No.: 196,740

[22] Filed: May 20, 1988

[30] Foreign Application Priority Data

May 20, 1987 [FI] Finland ..... 872224

[51] Int. Cl.[4] ..... B65H 18/20

[52] U.S. Cl. ..... 242/66

[58] Field of Search ..... 242/57, 75.1, 75.2, 242/67.1 R, 66, 56, 65, 75.51, 75.5

[56] References Cited

U.S. PATENT DOCUMENTS 4,150,797 4/1979 Kataoka ..... 242/75.2 X

FOREIGN PATENT DOCUMENTS 0124642 4/1984 Japan ..... 242/57

0242161 12/1985 Japan ..... 242/57

0417769 10/1934 United Kingdom ..... 242/66

*Primary Examiner*—John M. Jillions

*Attorney, Agent, or Firm*—Steinberg & Raskin

[57] ABSTRACT

Method for controlling the reeling of a web, in which the radius and/or any other corresponding quantity of the roll that is being formed, is measured by means of detectors with the signals thereof being passed to a control system. Adjusting signals controlled by roll diameter data measured on the basis of table and/or functional data stored in a memory of the control system for different radii of the roll, are formed in the control system by which a belt carrying member is controlled, this member being situated on an adjoining quadrant of the roll being would relative to a carrier roll. The supporting linear load of this belt carrying member is controlled by adjusting the tensioning of the supporting belt. The steps of the present method are carried out so that a suitable distribution of linear load in a reeling nip is carried into effect and so that the supporting and carrying linear loads of the roll being wound remain within preset limits.

16 Claims, 5 Drawing Sheets

METHOD FOR CONTROLLING THE REELING OF A WEB

BACKGROUND OF THE INVENTION

The present invention concerns a method for controlling the reeling of a paper web or equivalent, in which the web is reeled by supporting the roll that is being formed on its circular, cylindrical outer surface by means of at least two supporting members. A first one of the supporting members in a direction of arrival of the web, is a carrier roll with the web being passed over a sector thereof to the reeling. This carrier roll forms a reeling nip with the roll being formed, which supports the roll being formed from below. Furthermore, a press member is situated at an opposite, upper side of the paper roll being formed, this press member preferably being a press roll, by means of which the roll being formed is stably maintained in reeling position.

In the forming of paper rolls reeled while supporting the same at the circumference thereof, a problem has been internal damage in the large and heavy rolls. This damage is produced, in particular, underneath the surface layer. Some of the most common damage involves crepe wrinkles in a transverse direction of the web, and web cracking. A principal cause of the damage has been ascertained to be an excessibly high nip pressure between the paper roll and the carrier roll, resulting from the weight of the paper roll or from an excessive press-roll loading.

In order for a roll of good quality to be obtained by means of a carrier-roll reel-up, it has been noted that linear load between the paper roll and the carrier roll should be about 1 to 4 kN/m. Within this range of linear load, it is possible as a rule to accomplish the desired distribution of tension in the roll.

When a carrier roll of a short radius is used, the above range of linear loading is exceeded at the final stage of reeling with large rolls that are wound, whereby the contact pressure rises to a level higher than that tolerated by a printing-paper roll. This results from a narrow nip area between the paper roll and the carrier roll. In a manner known in the prior art, attempts have been made to eliminate this problem by making the carrier roll larger, which increases the cost of manufacture and operation of the reel-up.

A soft-faced carrier roll is known from Finnish patent application No. 843184, in which the nip face becomes larger. However, a drawback therein is the dynamic problem of formation of two faces, as well as the generation of heat during the reeling.

Attempts have also been made to solve these problems by dividing the load on carrier rolls of different sizes or on inclined carrier rolls. Distribution of the load between rolls does not reduce the maximum pressure, but it increases the pressure between one of the carrier rolls and the paper roll depending on the diameter and on the inclination. The most uniform distribution of the roll pressure is obtained with equally large carrier rolls situated symmetrically underneath the paper roll, by using the construction known from U.S. Pat. No. 4,456,190.

SUMMARY OF THE INVENTION

Accordingly, it is a principal object of the present invention to provide a method for controlling a reel-up into a roll with support at the circumference of the roll thereof, in which a roll such as a paper roll as good as possible is obtained. In other words, it is an object of the present invention to attain a reeled-up roll without any reeling defects and with desired distribution of density as a function of the roll diameter.

It is also an object of the present invention to provide a method for controlling a reel-up of a web into a roll, in which the reeling process itself is controlled from exchange of rolls, i.e. from start of the reeling, up to the finally completed roll.

It is another object of the present invention to provide a method for controlling and regulating the reeling-up into a roll, in which is possible to take and apply combinations of new adjusting parameters during the reeling up operation, whereby the reeling-up is efficiently carried out, and the various goals and objects of the present invention are achieved.

It is a further object of the present invention to provide a method for controlling the reeling-up into a roll, by which diameter and weight of the rolls so reeled-up can be increased, if necessary, as compared to rolls that have been reeled by means of prior art reel-ups at the support of the circumference thereof.

These and other objects are attained by the present invention which is directed to a method for controlling reeling of a web, comprising the steps of measuring at least radius of a roll that is being formed by a reeling with at least one detector, then passing measurement signals from the at least one detector to a reeling control system, storing predetermined values in a memory of the control system and comparing the measurement signals with the stored values and thereby forming adjusting signals in the control system, and then adjusting support of the roll being formed with the generated adjustment signals. The roll may be supported from underneath by a carrier roll, with an incoming web to be reeled being passed over a sector of the carrier roll. Furthermore, the roll may be stabilized in reeling position with a press member situated at an upper side of the roll being formed. The roll may be supported, at least when the reeled up radius passes a certain size, by a belt, in which roll support is adjusted by at least adjusting tension of this supporting belt, which in turn adjusts linear load of the belt support. The supporting belt may be adjusted so that with larger radii of the roll being formed, a supporting sector provided by the belt along an outer circumference of the roll is several times larger as compared to a supporting sector formed by a supporting roll nip.

Additionally, the adjusting step may be programmed and controlled to provide a substantially suitable distribution of linear load in a nip formed by the carrier roll and the web roll as a function of radius of the web roll, and to maintain other supporting linear loads within predetermined limits, thus permitting a substantially undisturbed reeling and good quality of the reeled roll to be attained. Furthermore, the press member may be a press roll.

Accordingly, with a view to achieving the objects noted above and those which will become apparent below, the present invention is principally characterized by a method comprising a combination of the following steps:

(a) The radius and/or any other, corresponding quantity of the roll that is being formed, is measured by means of one or several detectors, and the measurement signals derived from these detectors are passed to the reeling control system;

(b) Adjusting signals are formed in the control system based on different radii or equivalent of the roll to be formed and which are stored in the memory of the control system, on the basis of table and/or functional data giving consideration to support geometry and statics of the roll, and also being controlled by the data measured in the above step (a);

(c) The belt carrying member is controlled by means of these adjusting signals from step (b), this belt being placed on an adjoining quadrant of the roll that is being formed relative to the carrier roll, said carrying member being arranged so that, with larger radii of the roll that is being formed, the carrying member has a supporting sector which is several times longer about an outer circumference of the roll in the direction of this outer circumference as compared to a supporting sector of a supporting roll nip;

(d) Adjusting of the supporting linear load generated in the above step (c), is carried out by adjusting tensioning of the supporting belt; and (e) The above steps (a) to (d) are programmed and controlled to be carried out in a manner such that a substantially suitable distribution of linear load in a reeling nip is carried into effect as a function of the radius of the roll being formed as well as in a manner such that the other supporting and carrying linear loads of the roll remain within predetermined limits to permit a substantially undisturbed reeling and a good quality of the roll to be obtained.

The quantity corresponding to the radius of the roll noted above in step (a), usually connotes such a quantity which illustrates progress of reeling and geometry of the roll being formed such as roll weight, roll density, amount of paper contained in the roll, height of core locks for a core supporting the roll, and/or speed of paper together with the reeling time. These above quantities can be measured by means of various detectors and systems known per se. Also, the regulating tables and/or functions may be stored in the memory of the system as functions of any of the above quantities, instead of the roll radius.

BRIEF DESCRIPTION OF THE DRAWINGS

The present invention will be described in further detail below with reference to certain exemplary embodiments thereof illustrated in the figures, and to which the present invention is not intended to be strictly confined. In the drawings

DESCRIPTION OF THE PREFERRED EMBODIMENTS

Figure 1:
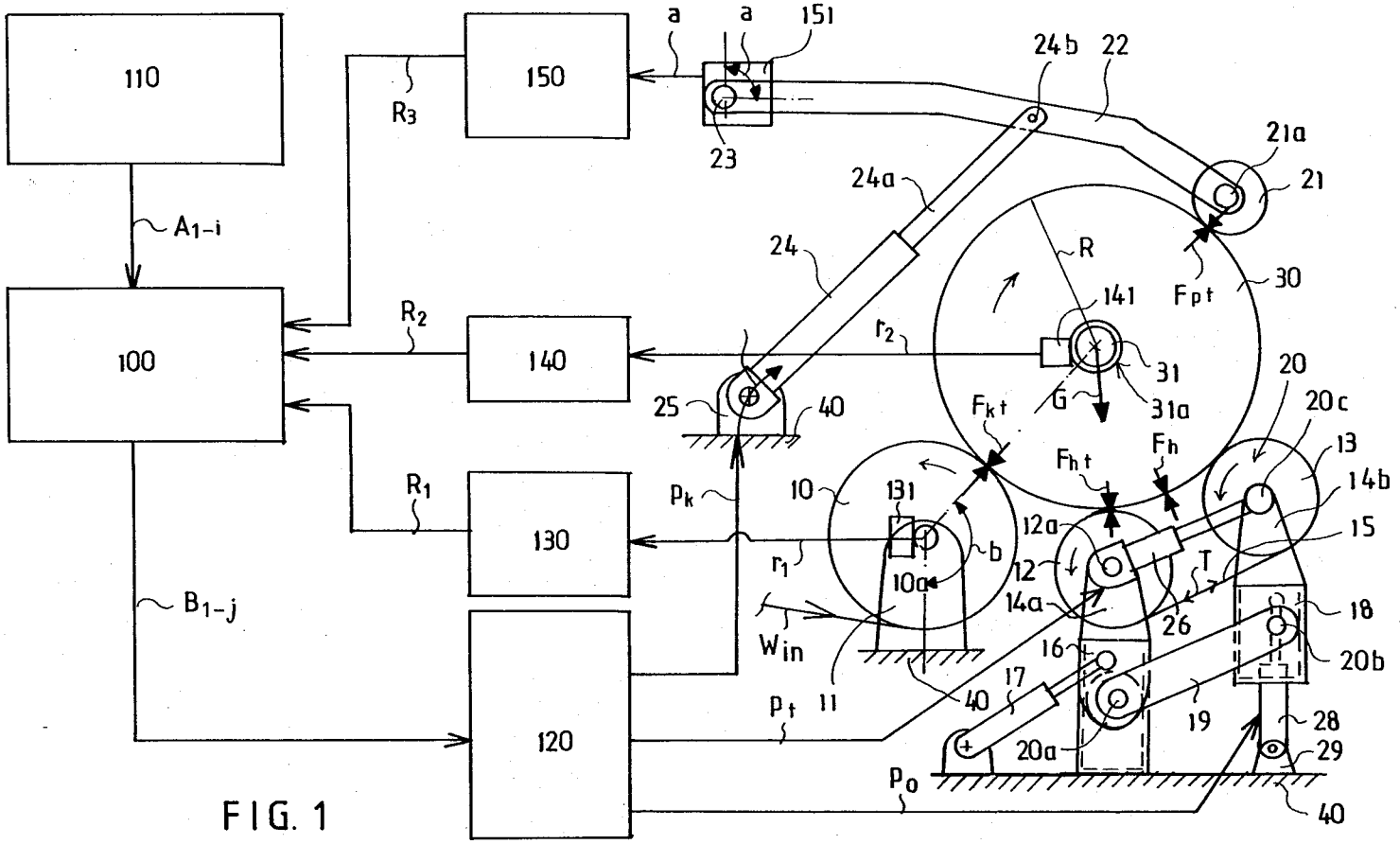
FIG. 1 is a schematic illustration of a reeling-up controlled by means of a control system in accordance with the present invention, at a final stage of reeling as well as a schematic illustration of a regulating system of the present invention as a block diagram.

FIGS. 1, 2A, 2B, 2C and 3 are schematic side views of a preferred exemplary embodiment of a reeling-up, the geometry thereof, and of statics involved in supporting a roll which are controlled by means of a control technique in accordance with the present invention at different stages of the reeling. The reeling-up illustrated in the figures comprises a rear carrier roll 10 which is provided with a drive 10*a*.The roll 10 is mounted at axle journals thereof on bearing supports 11 which are attached to a frame part 40 of the device, which is only illustrated schematically.

The reeling-up in accordance with the invention further involves a press roll 21 which is provided with a drive 21*a*. The press roll is attached to arms 22, which are linked to the frame part 40 of the device permanently at an articulation point 23. The press roll 21 is loaded by cylinders 24 which are, at articulation points 25, attached to the frame part 40. The piston rods 24*a* of the cylinders 24 are attached to the arms 22 at articulation points 24*b*.

In addition to the carrier roll 10, the roll 30 that is being formed is also supported from underneath by an upper run of a carrier belt 15 which runs between belt rolls 12 and 13. A first belt roll 12 is provided with a drive 12*a*. The belt roll 12 is mounted at its axle journals on supports 14*a* which are in turn attached to an intermediate part 16 which is supported on the frame 40 of the invention device through cylinders 17 and articulated joints 20*a*. The second belt roll 13 is mounted by its axle journals on bearing supports 14*b* (i.e. through an articulation part 20*c*), which are fitted in connection with the intermediate part 18. This intermediate part or member 18 is attached to the intermediate part 16 through an intermediate arm 19 and horizontal joints 20*a* and 20*b*. The intermediate part 18 is also connected to the frame part 40 at both of its ends through a pair of hydraulic cylinders 28 and supports 29.

Reference numeral 20 denotes the overall belt 15 supporting arrangement for the roll 30 that is being formed. Additionally, the incoming web $W_{in}$ passes over a certain sector b of the carrier roll 10, as illustrated in FIG. 1.

Positions of the belt rolls 12 and 13 are substantially fixed, while the position of the belt roll 13 may be altered only to the extent that it is necessary in order to adjust the tensioning T of the belt 15. This will be described in greater detail below.

FIG. 1 is a schematic side view, it being understood that for support of the various rolls 10, 12, 13, 21, there are corresponding axle journals, supports, arms 22, cylinders 24 and 28, only one of which is illustrated in FIG. 1. The construction of the reeling-up technique in accordance with the present invention has been described above very concisely, and only to the extent necessary for understanding the control method in accordance with the present invention. An advantageous exemplary embodiment of construction of a reeling-mechanism is described in Valmet Finnish patent application No. 872225.

Figure 3:
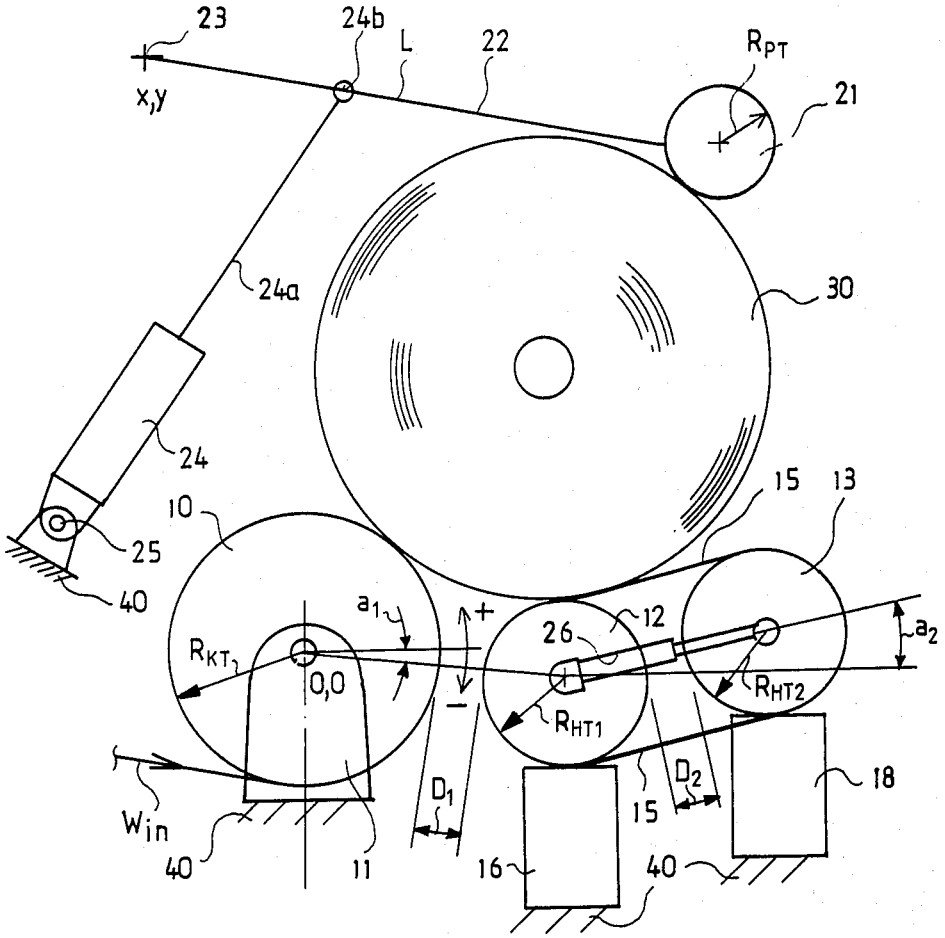
FIG. 3 illustrates essential quantities and parameters related to geometry and statics of the reeling-up and of the support of the roll in accordance with the present invention.

Referring to FIG. 3, the radius $R_{KT}$ of the rear roll 10 must be chosen in accordance with the width and the running speed of the machine. As a rule, $R_{KT}$=about 500 to 1000 mm, preferably about 500 to 850 mm. The bending of the belt 15 and the durability of the bearings determine the radius $R_{HT1}$ of the belt roll 12. As a rule, $R_{HT1}$ is roughly equal to about 300 to 600 mm, preferably about 400 mm. The radius of the second belt roll 13, $R_{HT2}$ may be the same as $R_{HT1}$. The radius $R_{PT}$ of the press roll 21 is determined by the radius of the core 31 and by $R_{KT}$ and $R_{HT1}$. $R_{PT}$ may be roughly equal to about 100 to 500 mm, preferably about 200 to 300 mm. The articulation point x, y of the press roll 21 and the length L of its arm are determined so that it is possible to load and to support the roll 30. Distance $D_1$ between the carrier roll 10 and the roll 12 is determined in accordance with the core 31, with the rolls 10 and 12, and with the press roll 21 so that it is possible to load the core ($\phi$ 90). $D_1$ is roughly equal to about 10 to 50 mm, preferably about 30 mm. An angle $a_1$ of the roll 12 relative to the carrier roll 10 determines the diameter with which the belt 15 begins supporting the roll 30. A large position angle $a_1$ causes a high nip load at the rear roll 10 (the weight of the roll tilts rearwardly). A large negative angle $a_1$ causes a need to load too much by means of the press roll 21. The angle $a_1$ is generally within the range of about $-20° < a_1 < 20°$. An angle $a_2$ of the roll 13 relative to the roll 12, together with $D_2$, determines maximum diameter $2R_0$ of the roll 30. If the roll 13 is shifted during running, $a_2$ also effects direction of the supporting force of the belt 15 during running and, consequently, the form of the tensioning function.

Geometry of the components of the reeling-up and the statics of the support are arranged in a manner such that, in the initial stage of reeling, first the roll core 31 and thereupon the roll 30 that is growing is supported from below by means of nips formed by the carrier roll 10 and by the first belt roll 12, and from above by a nip formed by the press roll 21. The linear loads in these three nips are adjusted so as to be of substantially the same order of magnitude as compared with one another. When the roll 30 grows and its diameter 2R exceeds about 400 to 700 mm, the roll 30 is supported from below also by the carrier belt 15, the tension T thereof being regulated. This tension T is increased with growing radius R of the roll 30.

Figure 2A:
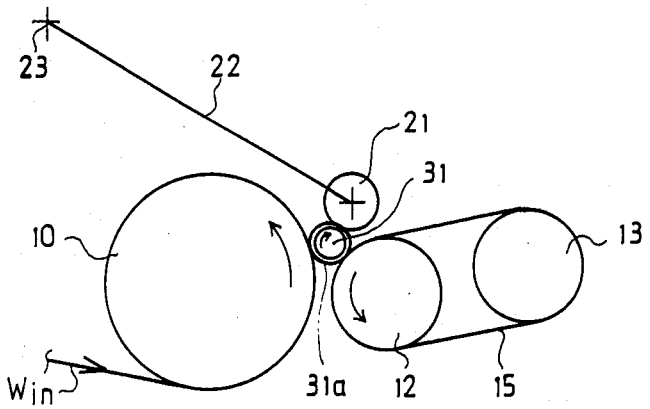
FIGS. 2A, 2B and 2C illustrate geometry of support of a roll as the roll diameter becomes larger at different stages of the reeling in accordance with the present invention.
Figure 2B:
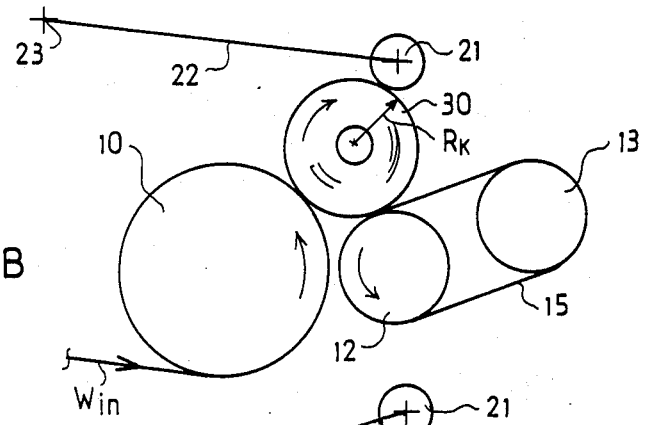

FIG. 2A illustrates the start of reeling. The core 31 onto which the roll 30 is reeled, has been conveyed under support by the core locks 31*a* into a space between the rolls 10, 12 and 21 so that these rolls form the supporting nips for the core 31 and for the roll 30 that is about to begin its growth. As shown in FIG. 2B, the diameter $2 \times R_k$ of the roll 30 has increased to about 400 to 700 mm. Distribution of nip pressure thereat in the nip 10/30 in a direction of the circumference of the roll is $p_{kt2}$, and the nip pressure in the extended nip 30/12,15 is $p_{ht2} + p_{h2}$, so that the belt 15 has, on its upper portion, begun supporting the roll 30 from below and the length of this nip in the direction S of the circumference has increased. The nip 10/30 has also become longer from the length $S_{k1}$ of the initial situation to the length $S_{k2}$, and the same time the peak pressure of $p_{maxk1}$ in the nip 10/30 has dropped to the pressure $p_{maxk2}$.

Figure 2C:
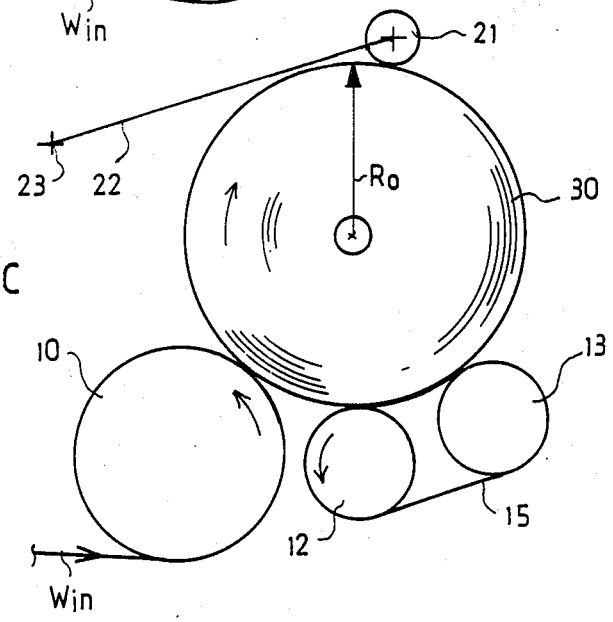
Figure 4:
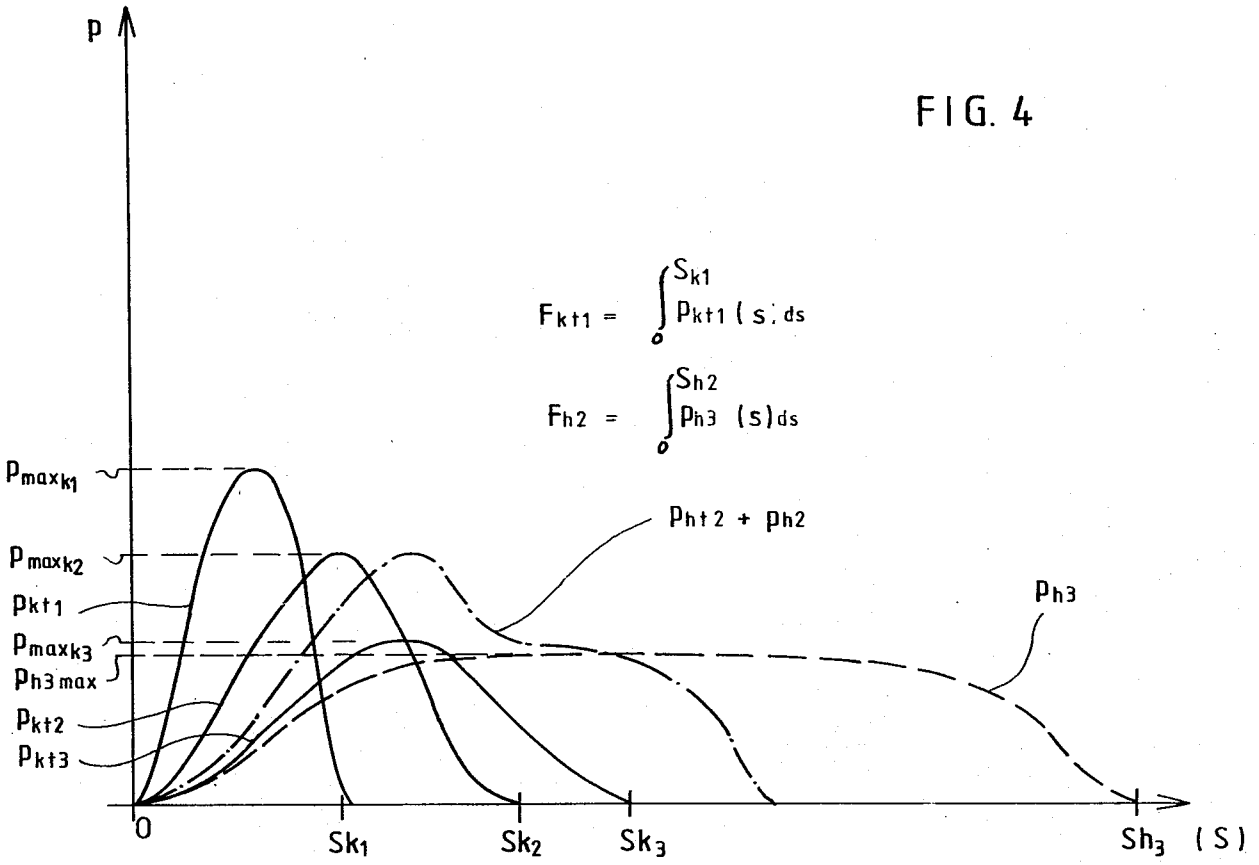
FIG. 4 illustrates a principle of distribution of pressures in the different supporting nips in a direction of a circumference of a roll in accordance with the present invention.

As shown in FIG. 2C, the roll 30 has grown to its full diameter $2 \times R_0$, whereby the length of the nip 10/30 has increased due to the increase in the radius of the roll 30, to the length $S_{k3}$ with the peak pressure having dropped to the pressure $p_{maxk3}$. At the same time, the length of the supporting zone of the belt unit 12, 15, 13 has increased to its full length $S_{h3}$, with the distribution of pressure $p_{h3}$ being evenly flat as illustrated in FIG. 4. It should be emphasized that FIG. 4 is, to a great extent, an illustration of principle concerning distribution of pressures, with the different pressure values and the length S of supporting nips not necessarily corresponding to reality.

The geometry and statics of the roll support in the reeling-up in accordance with the present invention as controlled by means of the reeling-up control method and system herein, will be described below with reference to the notations in FIG. 1. In a static consideration, the roll weight G and a vertical component of a linear load $F_{pt}$ of the press roll 21 are supported by vertical components of linear load $F_{kt}$ of the carrier-roll nip 10/30, the linear load $F_{ht}$ of the first belt roll 12, and the linear load $F_h$ caused by tensioning T (N/m) of the belt 15. The roll 30 and the second belt roll 13 have no loaded nip.

A corresponding static equilibrium prevails with respect to the horizontal components of the linear loads $F_{kt}$, $F_{ht}$, $F_h$ and $F_{pt}$. The system is made exacting with a view to control of the operation of reeling, by the fact that the geometry and statics of the system as well as the linear loads which are optimal in view of the reeling, keep changing all the time as the radius R of the roll 30 increases.

In the control method of the present invention, a starting point has been the observation that distribution of density of the roll 30 as a function of the radius R is principally determined by the distribution $F_{kt}(R)$ of the linear load of the rear carrier roll 10. This is, above all, due to the fact that the web $W_{in}$ is introduced onto the roll 30 exactly through the rear-roll nip 10/30. As a rule, an invariable density of the roll 30 as a function of the radius R is intended. The linear load $F_{kt}$ in the nip 10/30 thereat, must be slowly rising along with the growth of the radius, as apparent from FIG. 5. With different paper qualities, the linear load $F_{kt}$ in the nip 10/30 must be at different levels, with the steepness of this change as a function of the radius R preferably being variable. In other words, the tension T of the belt 15 and the belt carrier member is adjusted, while possibly the linear load $F_{pt}$ of the press roll 21 is also adjusted, so that the linear load $F_{kt}$ of the carrier roll 10 slowly increases as a radius R of the roll 30 is increased, with the distribution of the density of the roll 30 that is being formed in the direction of its radius R being controlled as desired, preferably substantially invariable.

The linear loads $F_{pt}$ and $F_{ht}$ of the roll 21 which contacts the roll 30 directly, and of the first belt roll 12 which contacts the roll 30 through the belt 15, must be within certain limits of which a lower limit is determined by the fact that the roll 30 must be adequately and stably supported during the reeling, and the upper limit being determined by the fact that the rolls 12 and 21 must not sink into the roll 30 to a disturbing extent.

The bearing supports 14*a* and 14*b* of the belt rolls 12 and 13 are interconnected by means of a pair 26 of hydraulic cylinders with a direction of movement being substantially parallel to a direction of the run of the belt 15 between the rolls 12 and 13. By passing a controlled pressure $p_t$ into the cylinders 26, it is possible to adjust the tension T of the belt 15. The pressure load caused by the tension T on the outer circumference of the roll 30 in a radial direction of the roll 30 can, in principle, be calculated from the formula $p = T/R$, so that this pressure load is also affected by the diameter of the roll in addition to the effect of changes in the geometry of the support.

It is an important feature of the control method in accordance with the present invention, that the control of the support of the roll is governed by measurement of the radius R of the roll 30, because the geometry and statics and support and formation of the roll 30 depend upon the radius R. According to FIG. 1, the radius is measured by means of a revcounter 131 of the carrier roll 10 and by means of a revcounter 141 of a core lock 31*a* with the signals $r_1$ and $r_2$ generated thereby, i.e. the number of revolutions rotated by the roll 10 and by the core lock 31*a* from the beginning of reeling, being passed to conversion units 130 and 140 whose output signals $R_1$ and $R_2$ are passed to a central unit 100 and represent the radius R of the roll 30, and from which the weight G of the roll 30 can also be directly derived if the grammage of the web W to be reeled has been fed from a set value unit 110 to the system 100. In order to ensure the operation, the radius R of the roll is also measured by means of a detector 151 by measurement of an angle a of the loading arms 22 of the press roll 21, from which the radius R of the roll 30 can be calculated by means of trigonometric functions in the unit 150. The resultant signal $R_3$ corresponding to the radius R is passed to the central unit 100 of the system.

In other words, in the method of the present invention, the radius R of the roll 30 is measured by counting the revolutions of the core lock 31*a* of the carrier roll of the roll 30 by means of detector devices 131, 141, and/or by measuring the position of the support member 22 of the press member 21 which is preferably a press roll, situated above the roll 30, or by measuring a position of a part attached in connection with the member 22, 21. The central unit 100 has been programmed so that if measurement results $R_1$, $R_2$ and $R_3$ differ from one another more than a certain preset value, the system gives a fault message and/or stops the reeling and/or shifts the control of reeling, e.g., so that it is based on the control signal $R_3$ alone. In other words, when the measurement signals $r_1$, $r_2$ differ by a certain value from the angle signal a, the system gives a fault message and/or stops and/or is transferred to control by the secondary control signal a alone. The signals $r_1$, $r_2$ and a as well as the control signals $R_1$, $R_2$ and $R_3$ derived on their basis in the units 130, 140 and 150, constitute the "feedback branch" of the closed control system in accordance with the invention.

The system includes a start-operation, stop-operation and set-value unit 110 by which the operation can be manually controlled to a certain extent. Moreover, certain set value data can be introduced into the system, such as data on the quality and density of the web to be reeled, i.e. a sort of species charts, which are fed as a series $A_{1-i}$ of set values to the central unit 100 of the system, to which unit 100 the control signals $R_1$ and $R_2$ have also been fed. The central unit 100 is either a controllable logic unit or a computer in which the values of the adjustment quantities $p_k$ and $p_t$ of the system as a function of the radius R of the roll, have been stored as tables or as functions separately for each of the different quality groups and for the individual qualities in the groups as modified e.g., by means of correction factors.

From the central unit 100 of the system, a series $B_{1-j}$ of adjustment signals is obtained which is passed to the converter and regulating unit 120 which comprises, e.g., electropneumatic converters, pressure regulators, pressure pumps, and pressure control valves, the latter ones providing the controlled pressures $p_k$ and $p_t$. By means of the pressure $p_k$, the power of the press-roll 21 relieving cylinder 24, i.e. the linear load $F_{pt}$, is adjusted and correspondingly, by means of the adjustable pressure $p_t$, the cylinder 26 which adjusts the tension T of the belt 15, i.e. the linear load $F_h$, is adjusted. Moreover, it is shown that a pressure $p_0$ is passed from the unit 120 to the pair of cylinders 28 supporting the roll 13 and the beam 18. As a rule, the pressure $p_0$ is maintained unchanged during the reeling, and is changed only in connection with the exchange, i.e. on starting the reeling and on removing the completed roll. The operation of the control system 100 is controlled by means of the control and set-value unit 110, where, by means of the series $A_{1-i}$ of electric signals provided from the unit 110, the reeling process is begun, the exchange of rolls is carried out, and the data concerning the species to be reeled are fed to the system, such as the density of the species to be reeled and/or the radius $R_0$ of the ultimately completed roll.

In the accompanying Table 1, the roll weight, the linear loads $F_{pt}$, $F_{kt}$, $F_{ht}$ and $F_h$, the pressures $p_k$ and $p_t$, and the belt 15 tension T are given at the values of 100 to 1500 mm for the roll diameters 2R, with steps of 100 mm. An objective of this table is to illustrate a preferred exemplary embodiment of the invention. The web W to be reeled is a SC or LWC paper of a density of 1200 kg/m$^3$, with the length of the roll being about 3.6 m.

The data listed in Table 1 are stored in the memory of the programmable logic unit or computer included in the central unit 100 as a table or as functions. When the species is changed, new tables or functions stored in the memory can be introduced into use, or the values of the preceding tables or functions can be modified by means of certain correction factors which are obtained either from the program or from the unit 110.

Figure 5:
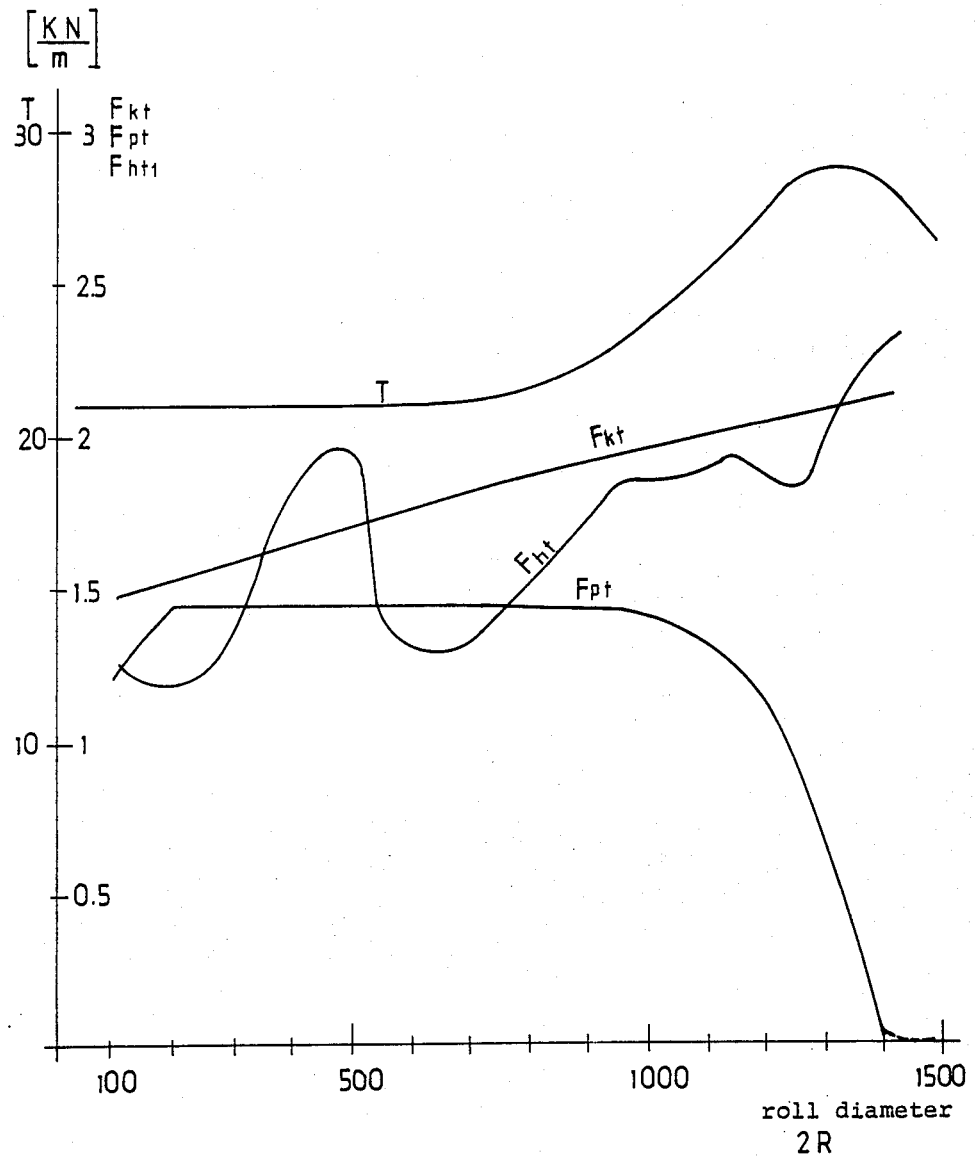
FIG. 5 is a graphical illustration of certain favorable control parameters as a function of a diameter of a roll being formed, in accordance with the invention herein.

From the accompanying Table 1 as well as from FIG. 5 the following can be noted. The weight G of the roll 30 naturally increases in proportion to the second power of the radius R. As can be concluded from the $F_{kt}$ column and from the curve in FIG. 5, $F_{kt}$ is evenly rising. An invariable distribution of density in the roll 30 is intended herein.

The tension T of the carrier belt 15 has a certain upper limit with consideration to the strength of the belt 15, this upper limit not being permitted by the control system to be exceeded in any situation. The linear load $F_{pt}$ of the press roll 21 dominates the roll control with smaller radii R, while with larger radii R the linear load $F_{pt}$ of the press roll 21 is lowered because the weight G of the roll is increasing.

According to the invention, when the tension of the belt 15 is used as the principal control quantity with larger roll diameters of $2R > 500$ mm, the linear load $F_{kt}$ can be controlled and the linear loads $F_{ht}$ and $F_{pt}$ can be kept within the permitted limits which are determined by the geometry of the reel-up and by the web W to be reeled. A further advantage is that when a sufficiently long ($S_{h3}$, FIG. 4) nip sector between the rolls 12 and 13 is used thereat, the surface pressure ($p_{h3max}$, FIG. 4) caused by the linear loading $F_h$ between the outer circumference of the roll 30 and the tensioned T belt 15, never becomes higher than permitted. With respect to this surface pressure, it is always possible to operate within an advantageous and safe area.

In other words, with diameters $2R <$ about 400–700 mm of the roll 30 to be formed, the tension T of the carrier belt is kept substantially invariable, while with the diameters $2R >$ about 400 to 700 mm of the roll 30, the tension T of the carrier belt 15 is raised up to a certain radius or value.

The preceding description of the present invention is merely exemplary, and is not intended to limit the scope thereof in any way.

TABLE 1

| 2R mm | G kg/3.6 m | $F_{pt}$ kN/m | $F_{kt}$ kN/m | $F_{ht}$ kN/m | $F_h$ kN/m | $P_k$ bar | $P_t$ bar | T kN/m |
|---|---|---|---|---|---|---|---|---|
| 100 | 34 | 1.20 | 1.46 | 1.29 | 0.00 | 41.88 | 95.49 | 20.00 |
| 200 | 136 | 1.45 | 1.55 | 1.18 | 0.00 | 32.37 | 95.49 | 20.00 |
| 300 | 305 | 1.40 | 1.59 | 1.35 | 0.00 | 32.75 | 95.49 | 20.00 |
| 400 | 543 | 1.45 | 1.65 | 1.81 | 0.00 | 33.30 | 95.49 | 20.00 |
| 500 | 848 | 1.45 | 1.70 | 1.96 | 0.56 | 33.82 | 95.49 | 20.00 |
| 600 | 1221 | 1.45 | 1.77 | 1.41 | 2.03 | 32.27 | 100.27 | 21.00 |
| 700 | 1663 | 1.45 | 1.85 | 1.29 | 3.27 | 30.65 | 100.27 | 21.00 |
| 800 | 2171 | 1.43 | 1.89 | 1.40 | 4.49 | 30.38 | 102.65 | 21.50 |
| 900 | 2748 | 1.40 | 1.90 | 1.62 | 5.79 | 31.27 | 107.43 | 22.50 |
| 1000 | 3393 | 1.40 | 1.95 | 1.83 | 7.30 | 29.00 | 114.59 | 24.00 |
| 1100 | 4105 | 1.30 | 2.00 | 1.85 | 9.12 | 28.71 | 124.14 | 26.00 |
| 1200 | 4886 | 1.10 | 2.03 | 1.94 | 10.97 | 32.88 | 131.30 | 27.50 |
| 1300 | 5734 | 0.65 | 2.08 | 1.82 | 12.99 | 41.99 | 137.03 | 28.70 |
| 1400 | 6650 | 0.01 | 2.12 | 2.20 | 14.53 | 52.30 | 133.69 | 28.00 |
| 1500 | 7634 | 0.01 | 3.34 | 2.35 | 16.25 | 49.80 | 123.19 | 25.80 |

What is claimed is:

1. Method for controlling reeling of a web, comprising the steps of measuring the radius of a roll that is being formed by said reeling, with at least one detector, passing measurement signals from the at least one detector to a reeling control system, storing predetermined values in a memory of the control system and comparing said measurement signals with said stored values, and thereby forming adjusting signals in the control system, adjusting support of the roll being formed with said generated adjustment signals, supporting the roll being formed from underneath with a carrier roll and passing incoming web over a sector of the carrier roll, stabilizing the roll being formed in reeling position with a press member placed at an upper side of the roll being formed, supporting the roll being formed with a belt at least when the reeled-up roll passes a certain radius in size, wherein the roll support is adjusted by at least adjusting tension of the supporting belt, which in turn adjusts linear load of the belt support, wherein said supporting belt is adjusted so that with larger radii of the roll being formed, a supporting sector provided by the belt along an outer circumference of the roll being formed is several times longer as compared to a supporting sector formed by a supporting roll nip, and programming and controlling said adjusting step to provide a substantially suitable distribution of linear load in a nip formed by the carrier roll and the web roll being formed as a function of radius of the web roll, and to maintain other supporting linear loads within predetermined limits permitting a substantially undisturbed reeling and good quality of the reeled roll.

2. The method of claim 1, wherein the press member is a press roll.

3. The method of claim 1, comprising the additional step of controlling a power unit which loads the press member with the generated adjusting signals.

4. The method of claim 3, wherein the power unit is an hydraulic relieving cylinder and the adjusting signals include an hydraulic pressure control signal.

5. The method of claim 1, wherein the belt is guided by two belt rolls situated in proximity to the web that is being wound, to form a loop, and the tension of the loop is regulated based on the radius of the roll being wound and by controlling power units fitted between shafts or shaft supports for the belt rolls.

6. The method of claim 5, wherein the power units comprise hydraulic cylinders which are controlled by controlling loading pressure thereof.

7. The method of claim 5, comprising the additional step of controlling the tension of the belt so that linear load in a support nip formed by one of the belt rolls situated closer to the carrier roll is maintained within about ±30% of an average value of the linear load.

8. The method of claim 5 comprising the additional step of arranging the carrier roll, press member, belt, and belt rolls so that, when reeling is initially begun, the roll being wound is first supported from below by the carrier roll and one of the belt rolls and from above by the press member, adjusting linear loads in three respective nips formed by the roll being wound and the carrier roll, belt roll, and press member respectively, to be substantially of the same order of magnitude, and after the web being wound increases to the certain radius in size, additionally supporting the web from below by the belt, the tension thereof being regulated and increased with growing radius of the web roll.

9. The method of claim 1, wherein the measuring is carried out by at least one of counting revolutions of a core about which the roll is being formed, counting revolutions of the carrier roll, and measuring position of a support component for the press member.

10. The method of claim 1, comprising the additional step of controlling operation of the control system with a control and set value unit whereby, by means of a series of electric signals provided by said control/-set value unit, reeling is carried out removal of a completely wound roll is carried out, and data concerning the web to be reeled is fed into the system.

11. The method of claim 10, wherein the data to be fed includes density of the web to be reeled, and ultimate radius of a completely wound roll.

12. The method of claim 1, comprising the additional steps of maintaining the belt tension substantially constant when the diameter of the web roll is less than about 400–700 mm, and increasing the tension of the belt when the diameter of the web roll increases past about 400–700 mm.

13. The method of claim 1, wherein the tension of the belt is adjusted so that linear load in a nip formed between the web roll and carrier roll increases slowly as the radius of the roll being wound increases and distribution of density of the roll being wound in a radial direction is controlled.

14. The method of claim 13, comprising the additional step of controlling linear load of the press member.

15. The method of claim 13 comprising the additional step of maintaining the roll density substantially invariable.

16. Method for controlling reeling of a web, comprising the steps of measuring the radius of a roll that is being formed by said reeling, with at least one detector, passing measurement signals from the at least one detector to a reeling control system, storing predetermined values in a memory of the control system and comparing said measurement signals with said stored values, and thereby forming adjusting signals in the control system, adjusting support of the roll being formed with said generated adjustment signals, supporting the roll being formed from underneath with a carrier roll and passing incoming web over a sector of the carrier roll, stabilizing the roll being formed in reeling position with a press member placed at an upper side of the roll being formed, wherein the measuring is carried out by counting revolutions of a core about which the roll is being formed, counting revolutions of the carrier roll, and measuring the position of a support component for the press member, comprising the additional step of, when measurement signals of the revolution countings differ from a measuring signal of the position of the press member support component by a certain value, carrying out at least one of the steps of issuing a fault message, stopping reeling, and transferring the measurement signal of the position of the press member support component to the central system.

* * * * *